US011680759B2

(12) United States Patent
Bandini

(10) Patent No.: US 11,680,759 B2
(45) Date of Patent: Jun. 20, 2023

(54) PISTOL WITH A ROTATING CLOSING DEVICE

(71) Applicants: FORCE 10 LIMITED, Abu Dhabi (AE); Nicola Bandini, Siena (IT)

(72) Inventor: Nicola Bandini, Siena (IT)

(73) Assignee: FORCE 10 LIMITED, Abu Dhabi (AE)

( * ) Notice: Subject to any disclaimer, the term of this patent is extended or adjusted under 35 U.S.C. 154(b) by 0 days.

(21) Appl. No.: 17/628,445

(22) PCT Filed: Jul. 13, 2020

(86) PCT No.: PCT/EP2020/069733
§ 371 (c)(1),
(2) Date: Jan. 19, 2022

(87) PCT Pub. No.: WO2021/013606
PCT Pub. Date: Jan. 28, 2021

(65) Prior Publication Data

US 2022/0268539 A1 Aug. 25, 2022

(30) Foreign Application Priority Data

Jul. 22, 2019 (IT) ..... 102019000012603

(51) Int. Cl.
*F41A 3/38* (2006.01)
*F41C 3/00* (2006.01)
*F41A 3/44* (2006.01)

(52) U.S. Cl.
CPC ..... *F41A 3/38* (2013.01); *F41A 3/44* (2013.01); *F41C 3/00* (2013.01)

(58) Field of Classification Search
CPC ..... F41A 3/78; F41A 3/44; F41A 5/02; F41A 3/38; F41A 3/36; F41C 3/00
(Continued)

(56) References Cited

U.S. PATENT DOCUMENTS 1,563,675 A * 12/1925 Tansley ..... F41A 17/38 89/196
3,241,449 A * 3/1966 Dwyer, Sr. ..... F41A 5/04 89/196

(Continued)

FOREIGN PATENT DOCUMENTS

EP 0359715 A2 3/1990

OTHER PUBLICATIONS

International Search Report and Written Opinion issued in corresponding International Application No. PCT/EP2020/069733, dated Sep. 24, 2020.

*Primary Examiner* — Joshua E Freeman
(74) *Attorney, Agent, or Firm* — Troutman Pepper Hamilton Sanders LLP

(57) ABSTRACT

A pistol comprising a barrel having a combustion chamber and slide translatable between an advanced configuration closing the combustion chamber, and a retracted configuration opening the chamber and in both configurations is substantially parallel to a longitudinal axis. The slide has a locking seat and longitudinal grooving. A closing organ rotatable with respect to the axis between a first and a second angular position and an element drawing in rotation the closing organ and fixed to the fore-end. The closing organ has a locking relief and a cam taking the rotation from the at least one element drawing in rotation. In the advanced configuration, the closing organ is in the first angular position so the locking relief engages the locking seat and the barrel and slide constrain each other, in the retracted configuration the closing organ is in the second angular position wherein the locking relief disengages from the locking seat and slides along the grooving so the slide can retract with respect to the barrel.

11 Claims, 5 Drawing Sheets

(58) Field of Classification Search
USPC ..... 89/163, 164, 138, 180, 194–197
See application file for complete search history.

(56) References Cited

U.S. PATENT DOCUMENTS 3,435,727 A * 4/1969 Miller ..... F41A 25/22 89/196
4,201,113 A * 5/1980 Seecamp ..... F41A 3/86 89/163
4,485,723 A * 12/1984 Sarony ..... F41A 3/86 89/198
4,916,843 A * 4/1990 Beretta ..... F41A 3/68 89/196
5,581,046 A * 12/1996 Weldle ..... F41A 3/86 89/196
5,753,848 A * 5/1998 Kart ..... F41A 3/14 89/16
5,808,229 A * 9/1998 Bastian ..... F41A 11/02 89/163
6,415,702 B1 * 7/2002 Szabo ..... F41A 17/56 42/70.08
7,340,987 B1 * 3/2008 Williams ..... F41A 9/71 89/196
9,546,831 B2 * 1/2017 Bandini ..... F41A 3/78
10,731,933 B2 * 8/2020 Streshinsky ..... F41A 5/02
2001/0029688 A1 * 10/2001 Beretta ..... F41A 5/04 42/75.04
2007/0084040 A1 * 4/2007 Pflaumer ..... F41A 3/36 29/458
2008/0289238 A1 * 11/2008 Lippard ..... F41A 5/04 42/75.02
2014/0196337 A1 * 7/2014 Bandini ..... F41A 5/02 42/16
2017/0198993 A1 7/2017 Dechant
2018/0306536 A1 * 10/2018 Ellis ..... F41A 3/38

* cited by examiner

PISTOL WITH A ROTATING CLOSING DEVICE

CROSS-REFERENCE TO RELATED APPLICATIONS

This is a U.S. national phase application under 35 U.S.C. § 371 of International Patent Application No. PCT/EP2020/069733, filed Jul. 13, 2020, which claims benefit of priority to Italian Patent Application No. 102019000012603, filed Jul. 22, 2019. The entire contents of these applications are hereby incorporated by reference.

TECHNICAL FIELD

The present invention concerns a pistol, preferably of a (semi-) automatic type. In particular, the present invention relates to a pistol known as "short recoil" type.

BACKGROUND

In "short recoil" pistols, following the firing, the slide and the barrel recoil simultaneously for a brief portion and keep the combustion chamber locked. Thereafter, a proximal portion of the barrel is decoupled or caused to deviate, by various types of mechanisms, having a common stroke with the slide to enable the opening of the combustion chamber, and then its reloading with a new munition. Purely by way of example, among the known types of closing systems we mention the geometric locks of the Browning, Colt, Glock or Sig-Sauer type.

Disadvantageously, in the known closing systems, following a high number of firing cycles, the geometric coupling precision among the barrel, slide and mechanisms for deviating or decoupling the barrel tends to reduce rapidly.

Usually the known-type mechanisms for deviating or decoupling the barrel from the stroke of the slide involve movements in a transversal direction to the extension direction of the barrel, thus transmitting undesired spurious movements to the whole firearm which, disadvantageously, tend to increase the rise of the pistol and consequently, for example in the rapid aimed firing cycle, to make aiming more difficult and costly in terms of time.

Also, the known-type mechanisms for deviating or decoupling the barrel from the stroke of the slide, often being movable in a vertical direction with respect to the extension direction of the barrel, introduce a volume which increases the distance between the longitudinal axis of the barrel and the closest point of the user's hand 1 along the grippable portion, and consequently the rise of the firearm increases.

SUMMARY

For this reason, an object of the present invention is to realize a pistol which with its closing system obviates the above-described drawbacks of the prior art, in particular by providing a device in which the kinematic mechanisms are conformed in such a way as to suffer a lower level of wear, and which do not require high production tolerances.

A further object of the present invention is to provide a pistol with a closing system having a smaller volume which enables a smaller rise with respect to the pistols of known type.

The technical task, as well as these and other objects, according to the present invention are attained by realizing a pistol according to the invention.

BRIEF DESCRIPTION OF THE DRAWINGS

Further characteristics and advantages of the invention will more fully emerge from the description of a preferred but not exclusive embodiment of the pistol according to the invention, illustrated by way of non-limiting example in the accompanying drawings, in which.

DETAILED DESCRIPTION

Figure 1:
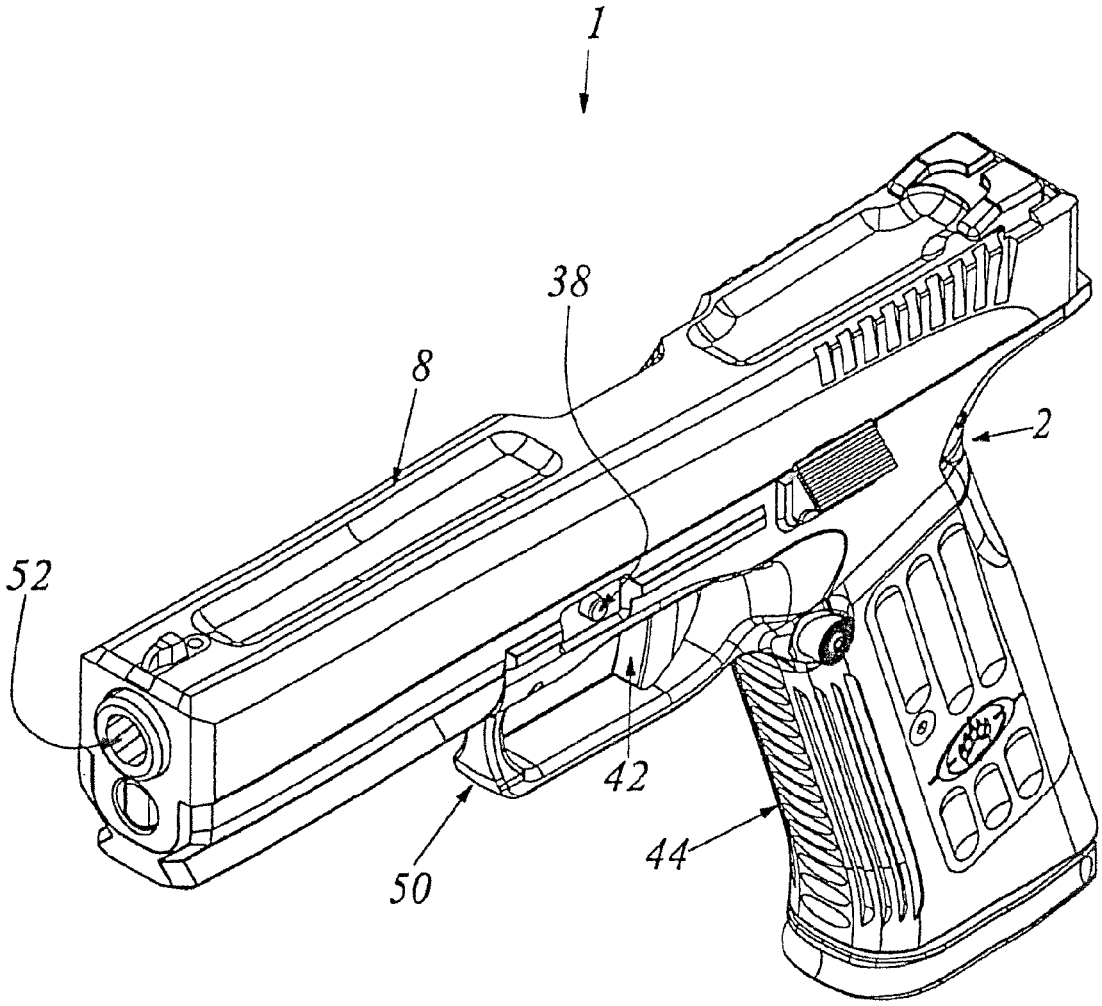
FIG. 1 shows a prospective view of the pistol, which is the object of the present invention, in accordance with an embodiment.

With particular reference to the figures, reference numeral 1 indicates a pistol. The pistol is preferably a semi-automatic pistol, advantageously of a short recoil type. The pistol 1 comprises a pistol fore-end 2 and a barrel 4.

The barrel 4 is movably supported by the pistol fore-end 2 in order to enable the barrel 4 to recoil.

In the embodiment illustrated in the figures, the pistol 1 comprises a trigger 42 rotatably connected to the fore-end 2. In other embodiments, not illustrated, the trigger 42 is translatably mounted on the fore-end.

In a preferred embodiment, the pistol fore-end 2 comprises a grip 44. The grip 44 is preferably realised ergonomically with respect to the hand of a user of the firearm.

In a further preferred embodiment, the pistol fore-end 2 comprises a support wall 46 connected to the grip 44 and extending distally therefrom.

In the present patent description, the terms "proximal" and "distal" refer to the position with respect to the grip 44. In particular, the term "proximal" relates to the components of the pistol that are positioned in proximity or towards the grip 44; while the term "distal" relates to the components positioned in proximity or towards a muzzle 48 of the firearm.

According to the embodiment shown in the figures, the pistol fore-end 2 comprises a trigger guard 50 connected to the support wall 46 and the grip 44. The trigger guard 50 is advantageously made in a single piece with the wall 46 and the grip 44. The barrel 4 proximally has a combustion chamber 6 extending along a longitudinal axis X, conformed in a suitable way for at least partial accommodation of a munition (not shown in the figures), preferably in the form of a cartridge.

The barrel 4 preferably opens distally through the muzzle 48, and in a preferred embodiment has one internal grooving 52 having a helical extension along the axis X with a right-hand or left-hand engagement.

In the embodiments in which it is present, the support wall 46 extends substantially in a parallel direction to the longitudinal axis X.

The pistol 1 comprises a slide 8. In particular, the slide 8 is translatable longitudinally with respect to the pistol fore-end 2 between an advanced configuration in which the slide closes the combustion chamber 6, and a retracted configuration in which it is distanced from the barrel 4 to open the combustion chamber 6.

In the advanced configuration, the slide 8 cooperates with the barrel 4 to close the combustion chamber 6; in particular, in this configuration an internal wall 54 of the slide 8 at least partly superposes on the proximal opening of the chamber.

Instead, in the retracted configuration (for example shown in FIG. 8) the slide 8 translates on the fore-end 2 proximally with respect to the advanced configuration, so that the internal wall 54 is arranged at a certain distance from the mouth of the combustion chamber 6; in this configuration, the combustion chamber is open.

At least one of the pistol fore-end 2, the slide 8 and the barrel 4 is preferably made of a plastic material.

In a preferred solution of the invention, all these components are made of a polymeric material.

Both in the advanced configuration and in the retracted configuration, the orientation of the combustion chamber 6 is substantially parallel to the longitudinal axis X. In other terms, following firing, the barrel 4 is subject to recoil and translates solidly with the slide 8 for a brief stroke, while conserving its orientation. In this way, in each step of the firing, the barrel 4 stays straight and in line, and any inclinations thereof are avoided.

The orientation of the barrel 4 preferably coincides substantially with the longitudinal axis X.

The barrel 4 advantageously externally comprises at least one sliding guide, preferably made substantially planar, facing and interacting with an internal surface of the slide 8. In this way, the slide 8 accompanies the barrel 4 in the recoil and the orientation and the perfect alignment of the barrel 4 are maintained in the other firing steps.

Said sliding guide preferably faces a wall 70 which superiorly delimits the slide. According to a variant embodiment, the barrel 4 comprises a plurality of sliding guides, positioned superiorly or laterally.

The pistol 1 comprises a striker 56 movable towards the combustion chamber 6 by means of a firing device activated by the trigger 42.

In the embodiment illustrated in the figures, the firing device is a striker-fired type. According to an embodiment that is not illustrated, the striker 56 is activated by a hammer rotatably mounted on the pistol fore-end 2.

In the illustrated embodiment, the striker 56 is housed, with possibility of longitudinal movement, in a seat 72 made proximally in the slide 8.

The slide 8 is preferably mounted slidably on the barrel 4, in particular parallel to the longitudinal axis X. In particular, as shown in the figures, the slide 8 comprises a distal wall 58 crossed by a barrel hole 60 translatably engaged by the barrel 4.

The slide 8 has at least one locking seat 16, 18 and at least one longitudinal grooving 20, 22.

The pistol 1 comprises a closing organ 10 that is rotatable with respect to the axis X between a first and a second angular position.

The pistol 1 comprises at least one element for drawing in rotation 100 the closing organ 10 fixed to the fore-end 2.

The closing organ 10 has at least one locking relief 12, 14 and at least one cam 101 for taking the rotation from the element for drawing in rotation 100.

In the advanced configuration, the closing organ 10 interacts with the barrel 4 and the slide 8, locking them so that they move in synchrony; while in the retracted configuration, the closing organ 10 releases the slide 8 so that the slide 8 proceeds in its retraction, independently of the barrel 4, to open the combustion chamber 6. Substantially, in the advanced configuration, the closing organ 10 is in the first angular position in which the locking relief 12, 14 engages the locking seat 16, 18 so as to make the barrel 4 and the slide 8 solidly constrained to one another, while in the retracted configuration, the closing organ 10 is in the second angular position in which the locking relief 12, 14 disengages from the locking seat 16, 18 and slides along the longitudinal grooving 20, 22 so as to enable retraction of the slide 8 with respect to the barrel 4.

As already mentioned, the closing organ 10 locks and unlocks the barrel 4 and the slide 8 via rotation about the axis X. In particular, between the advanced configuration and the retracted configuration of the slide 8, the closing organ 10 rotates with respect to the axis X by an angle of rotation A in order to lock/unlock the synchronous movement of the barrel 4 and slide 8.

In the retracted configuration, the closing organ 10 preferably has an angle of rotation equal to—A with respect to the advanced configuration, in which it has an angle of rotation of 0° with respect to the axis X. In other words, by exploiting the above-mentioned rotation with respect to the axis X, the closing organ 10 releases the slide 8.

In particular, the closing organ 10 is connected to the pistol fore-end 2 by means of the element for drawing in rotation 100 fixed to the fore-end 2 in such a way as to be rotated with respect to the axis X.

In greater detail, the at least one element for drawing in rotation 100 is slidably housed in the at least one cam for taking the rotation 101.

Each element for drawing in rotation 100 cooperates with the respective cam for taking the rotation 101, in which it is permanently housed, guiding the rotation of the closing organ 10 by an angle A both in one direction and the other.

The element for drawing in rotation 100 is preferably made in the form of a drawing pin.

Note that the pistol 1 comprises a dismounting pin 38 of the slide 8 from the pistol fore-end 2 separate and structurally independent from the drawing pin.

In particular, the drawing pin has a smaller diameter than the dismounting pin 38. In particular, the dismounting pin 38 is orientated in a perpendicular position with respect to the direction of the longitudinal axis X.

In greater detail, the drawing pin 2 fixed to the fore-end is inclined with respect to the dismounting pin 38.

Each drawing pin 100 is preferably inclined in a radial direction with respect to the axis X.

Each cam for taking the rotation 101 is preferably made in the form of a recess having a helical extension.

In particular, the recess having a helical extension 101 extends about the axis X. In this variant the rotation of the closing organ 10 with respect to the axis X is substantially equal to the difference in angle between the vertices delimiting the cams for taking the rotation 101 in the closing organ 10.

The closing organ 10, between the first angular position and the second angular position, preferably rotates by an angle A comprised between n/18 rad and n/6 rad, corresponding to a range of between 10° and 30°.

More preferably, the angle of rotation A is comprised between n/12 rad and n/10, corresponding to a range of between 15° and 18°; still more preferably the angle A is 47c/45, corresponding to 16°.

In particular, in a variant the whole closing organ 10 rotates, performing a closing-opening arc corresponding to an angle of rotation A.

In a preferred embodiment of the invention, the closing organ 10 is solidly constrained in translation to the barrel 4, though with freedom of rotary movement with respect to the axis X.

In particular, the closing organ 10 is connected to the fore-end 2, so as to be guided along an axial direction X, performing a rotation with respect to the axis X.

In other words, the closing organ 10 performs a roto-translation along the axis X between the advanced configuration and the retracted configuration of the slide 8. The closing organ 10 is engaged with the barrel 4 distally to the combustion chamber 6 and is preferably arranged in a position comprised between the combustion chamber 6 and the muzzle 48.

According to a further embodiment, the closing organ 10 is at least partly superposed on the combustion chamber 6.

According to a further embodiment, the closing organ 10 interacts with the barrel 4 distally of the trigger 42.

According to a significant aspect, the closing organ 10 comprises said at least one locking relief 12, 14 which carries out a double function as a locking component in the advanced configuration and as a sliding guide of the slide 8 in the retracted configuration.

In particular, in the advanced configuration, the locking relief 12, 14 engages a locking seat 16, 18 of the slide 8. In this way, as long as the locking relief 12 is engaged in the locking seat 16, 18, the organ 10 cannot be moved with respect to the slide 8; in the same way, in the embodiment in which the organ 10 is solidly constrained in translation to the barrel 4, the barrel 4 too remains solidly constrained to the slide 8.

In the retracted configuration, the locking relief 12, 14 is deconstrained from the locking seat 16, 18, and functions as a translation guide for the slide 8 and can follow the retracting stroke deconstrained from the stroke of the barrel 4.

A plurality of locking reliefs 12, 14 is preferably included, so that they operate on opposite longitudinal walls 62, 64 of the slide 8.

According to a preferred embodiment, the longitudinal walls 62, 64 are connected to one another via the wall 70 so that, in accordance with the variant, the reliefs 12, 14 are adapted to couple with the slide 8 at the connecting zone between the above-cited walls 62, 64, 70.

In a particularly preferred embodiment, the locking relief 12, 14 (or the plurality thereof) is engaged slidably along the longitudinal grooving 20, 22 of the slide 8. In fact, at least one of the longitudinal walls 62, 64 of the slide 8 (preferably both) internally comprises at least one longitudinal grooving 20, 22, preferably in a same number as the number of locking reliefs 12, 14, which interacts with the closing organ 10.

The locking seat 16, 18 and the longitudinal grooving 20, 22 are preferably reciprocally in communication. In this way, the locking relief 12, 14, once released from the locking seat 16, 18, inserts directly into the longitudinal grooving 20, 22. According to an advantageous embodiment, the locking relief 12, 14 is given a radial prominence with respect to a parallel axis to the axis X, which can be asymmetric, having an extension that is substantially parallel to the longitudinal axis X.

The use of a prominence has been shown to be of particular advantage for realizing the relief, as this conformation provides a longitudinal surface sufficiently large as to guide the slide reliably and straight, and to be extremely resistant due to the locking of the slide.

According to an embodiment, the barrel 4 comprises at least one abutment projection 24, 26, which extends radially (with respect to axis X) from the external surface thereof, so as to influence the closing organ 10.

Figure 4:
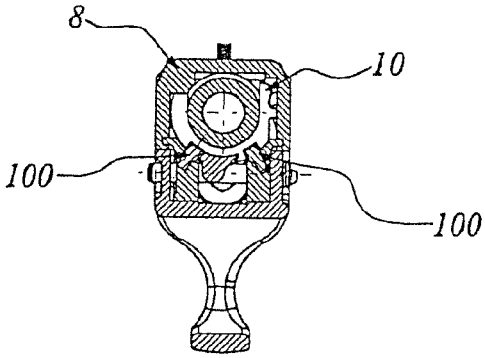
FIGS. 4, 6 and 8 are transversal sections, corresponding to the operating steps of FIGS. 3, 5 and 7, along lines IV-IV, VI-VI and VIII-VIII of those figures.

As is for example shown in FIG. 4, the abutment projection 24, 26 is arranged proximally on the tubular body of the barrel 4 and has for example a lip shape, which realizes an abutment for the closing organ 10.

A plurality of abutment projections 24, 26, axially spaced, is preferably included to delimit a seat 28 for slidable housing of the closing organ 10. In this way each abutment projection 24, 26 is bilaterally retained during the barrel recoil steps. The seat 28 identified by the barrel 4 for the slidable housing of the closing organ 10 is preferably positioned distally with respect to the combustion chamber 6, and advantageously also with respect to the trigger 42.

According to a preferred embodiment, the closing organ 10 has an internal surface with a cylindrical sector conjoined to the external surface of the barrel 4 and an external surface with a cylindrical sector along which the cam 101 extends.

In particular, the locking relief 12, 14 is projecting from the external surface having a cylindrical sector of the closing organ 10.

The closing organ 10 preferably comprises a connected first and a second annular portion 30, 32 which delimit between them a recess 34 for housing of a preferably proximal portion of the barrel 4.

In other words, the annular portions 30, 32 extend in such a way as to surround the recess 34 in which the barrel 4 is arranged.

According to a preferred embodiment, the annular portions 30, 32, are of a sufficient length to contain prevalently the barrel bore.

Figure 2A:
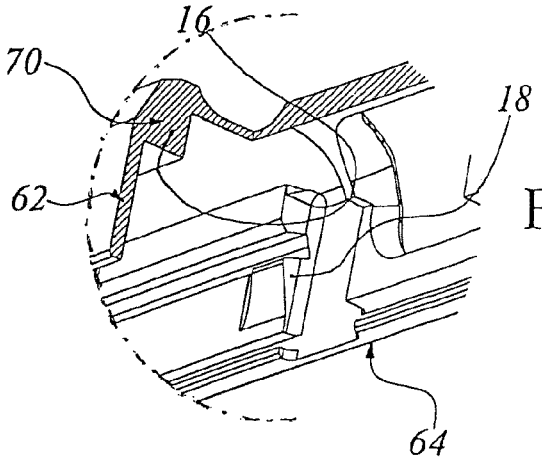
FIG. 2*a* shows a larger-dimension view of the zone evidenced in FIG. 2*b;*
Figure 2B:
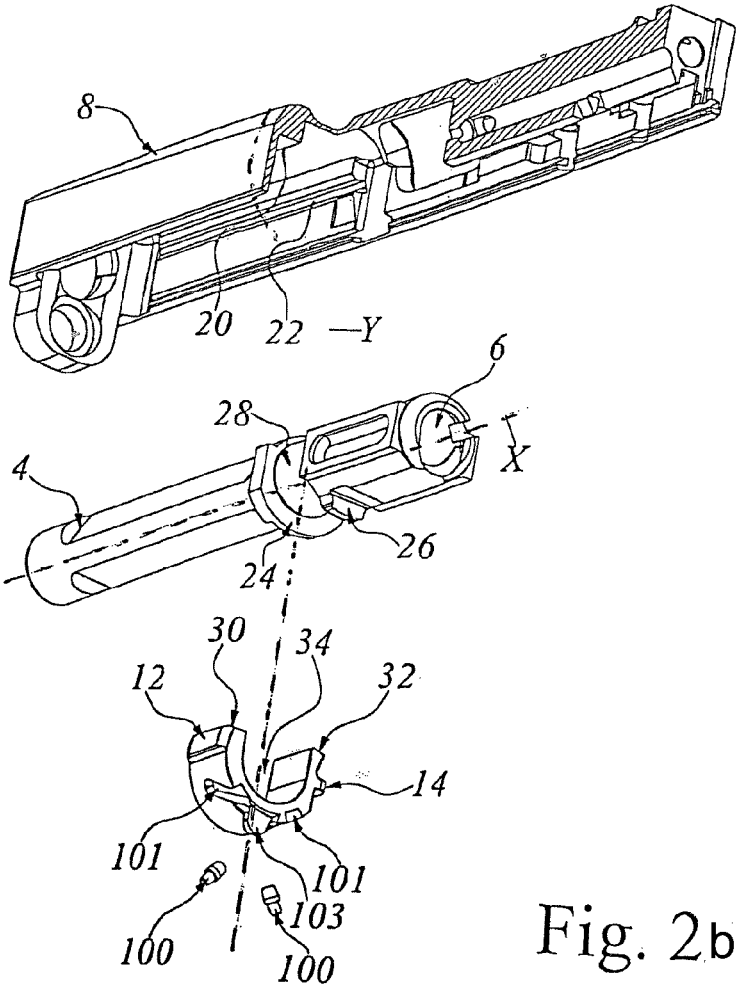
FIG. 2*b* shows an exploded perspective view of the closing system which is the object of the present invention, in accordance with a possible variant, used in the pistol of FIG. 1.
Figure 8:
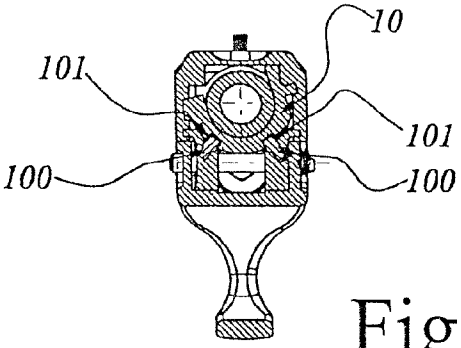

In the present patent description, the term "prevalently" is taken to mean that, as visible in FIG. 2 or 8, the annular portions 30, 32 delimit a recess having a depth of at least 50% of the outer diameter of the barrel 4, preferably at least 65%, still more preferably 75-80% or more. Still more preferably, the locking relief 12, 14 is arranged on at least one of said annular portions 30, 32, preferably at the free ends thereof, and is externally projecting.

In a preferred embodiment of the invention, the closing organ 10 is realized in the shape of a semi-annular block.

The closing organ 10 is advantageously rotatable about the axis X and does not perform movements perpendicular to the axis X. In this way, the dimensions of the closing organ 10 can be reduced with respect to the known closing organs and consequently the weight thereof. The rotary movement about the axis X of the closing organ enables significantly reducing the dimensions and therefore the weight of the closing organ 10 with respect to the prior art.

According to a particular aspect, as mentioned in the foregoing, the pistol 1 comprises the dismounting pin 38 for field stripping of the firearm, structurally independent and separate from the drawing pin 100.

Differently to the closing mechanisms of the prior art, the dismounting pin 38 does not interact with the closing organ 10 and therefore is not subjected to high mechanical stresses.

Therefore, the dismounting pin 38 has the sole function of enabling the dismounting of the firearm and is made of smaller dimensions than the dismounting pegs of like known pistols.

The closing organ 10 advantageously has a locking and gripping peduncle 103 for the locking and gripping thereof for field stripping the firearm, which engages the dismounting pin 38 of the slide 8 from the pistol fore-end 2.

Therefore, in accordance with the variant, the dismounting pin 38 can be disengaged from the pistol fore-end 2 to dismantle the firearm.

A brief description of the operation of the pistol 1 is now provided.

Figure 3:
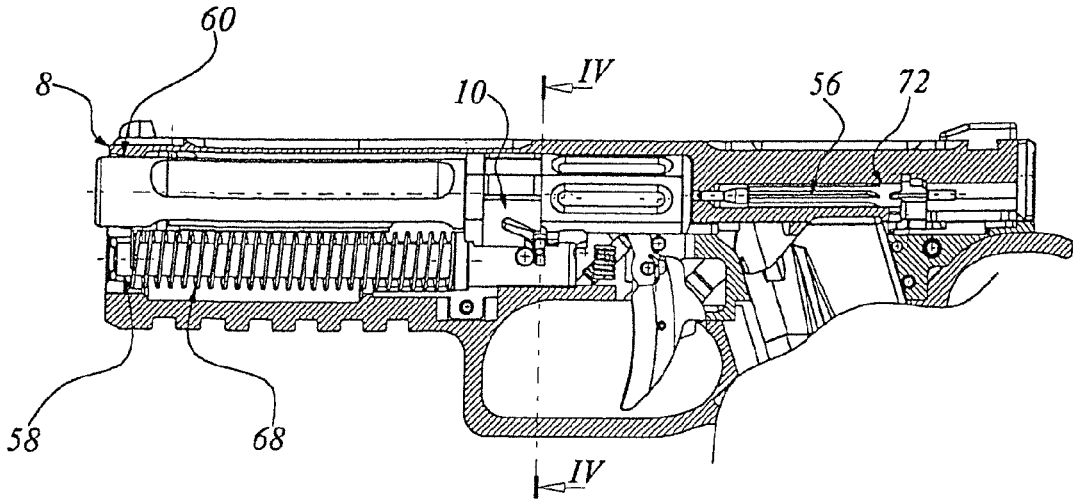
FIGS. 3, 5 and 7 show lateral views in partial section of the pistol of FIG. 1, during various steps of firing the firearm.

In a step preceding the firing, a cartridge (not illustrated) is inserted in the combustion chamber 6 and FIG. 3 shows the relative position between the pistol fore-end 2, the barrel 4 and the slide: a recall spring 68, positioned slidably in the extension configuration in a seat made between the barrel 4 and the fore-end 2, maintains the distal end of the slide 8' substantially aligned to the free portion of the support wall 46.

The closing organ 10, arranged in proximity of the longitudinal axis X, solidly constrains the barrel 4 and the slide 8, as it occupies the seat 28 of the barrel 4 and halts the slide 8 by means of the geometric coupling between the locking reliefs 12, 14 and the locking seats 16, 18.

Initially, before firing, each drawing pin 100 fixed to the fore-end 2 is arranged at the proximal vertex of the respective cam for taking the rotation 101 realized on the closing organ 10.

Once the trigger 42 has been activated, the striker 56 is moved towards the combustion chamber 6, so as to prime the cartridge and cause it to fire.

Once the cartridge has been primed, a bullet exits distally from the muzzle 48, and consequently, as a reaction, the assembly constituted by the barrel 4, closing organ 10 and slide 8 recoils by a few millimeters.

Figure 5:
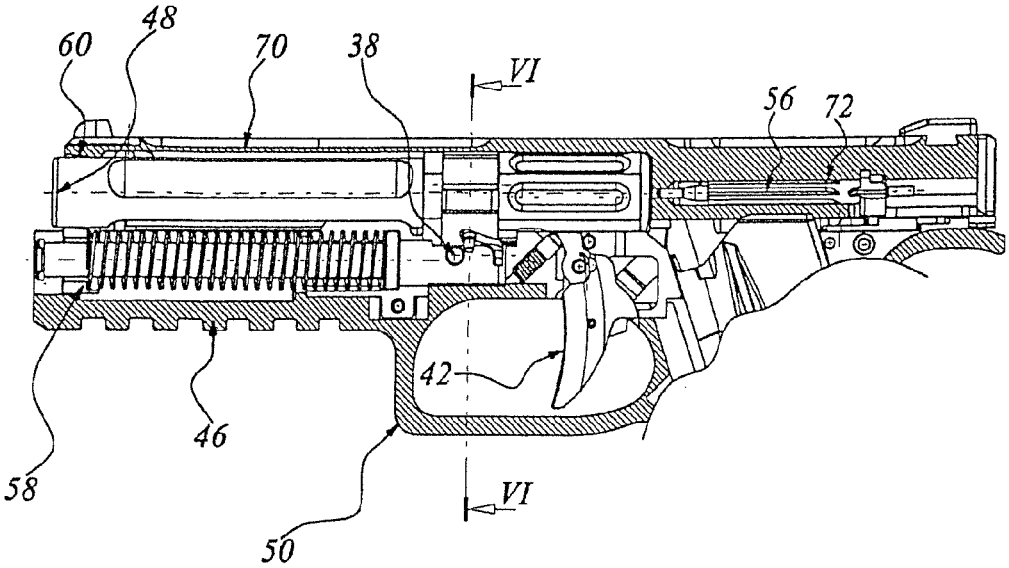
Figure 6:
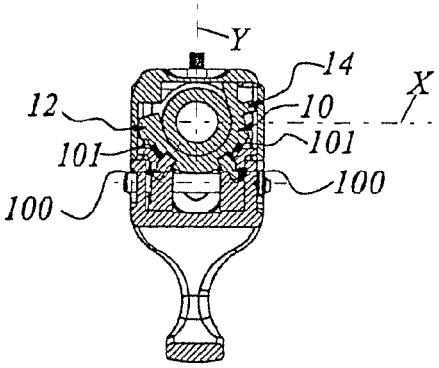

In fact, as illustrated in FIG. 5, the barrel 4 is translated proximally with respect to the fore-end 2 and the distal end of the slide 8' is retracted with respect to the free portion of the support wall 46.

Owing to the combined movement of the longitudinal translation of the barrel 4 and the sliding of the cam for taking the rotation 101 on the drawing pins 100, the closing organ 10 is radially rotated on the longitudinal axis X. When the closing organ 10 has rotated by an angle A on the axis X, the locking reliefs 12, 14 have exited from the locking seat 16, 18 and have aligned to the longitudinal groovings 20, 22 of the slide 8. Note that once the rotation of the closing organ 10 has been completed, each drawing pin 100 fixed to the fore-end is arranged at the distal vertex of the respective cam for taking the rotation 101 realized on the closing organ 10.

In this way, the slide 8 is deconstrained from the barrel 4, which has reached an end-stroke.

The combustion chamber 6 has not undergone inclinations and the orientation thereof has remained substantially coinciding to the axis X.

Thereafter, the pressure inside the combustion chamber 6 is sufficiently high to overcome the recall force of the recall spring 68, thus causing the slide 8 to continue in its retraction by initializing the opening of the combustion chamber 6. During this retraction the longitudinal groovings 20, 22 slide on the locking reliefs 12, 14 of the closing organ and the reliefs thus function as translation guides for the slide 8 that when retracting places the recall spring 68 under compression. The presence of at least two locking reliefs 12, 14 and other groovings make this movement highly balanced and reproducible.

Figure 7:
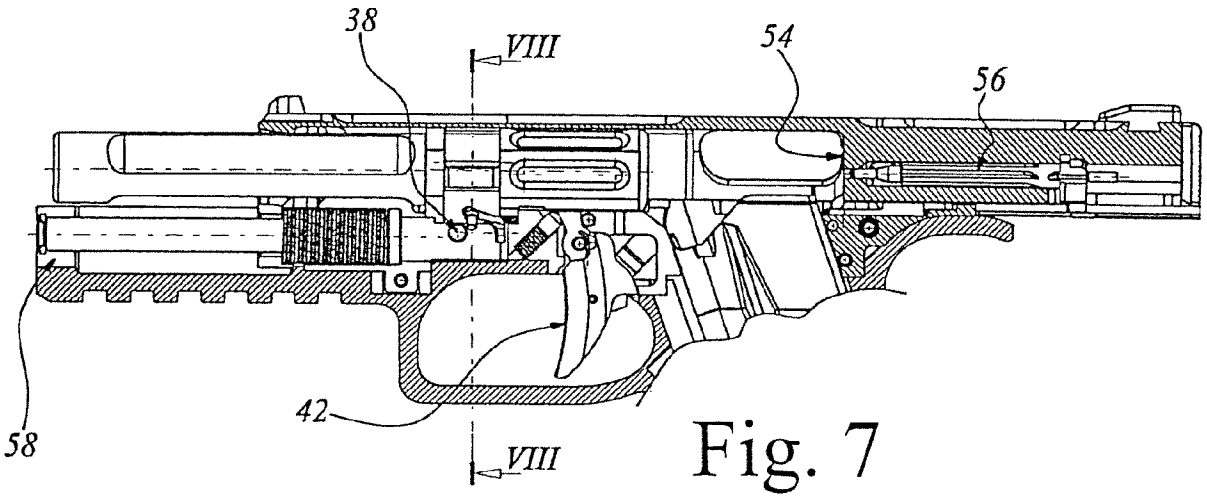

Lastly, when the pressure in the combustion chamber is sufficiently low to be overcome by the recall force of the recall spring 68, now in the compressed configuration, as shown in FIG. 7, the slide 8 inverts it motion, moving distally, and repositions the assembly constituted by the barrel 4, the closing organ 10 and the slide 8 in the position prior to firing as illustrated in FIG. 3. In this configuration, the pistol 1 is ready for a new firing cycle.

The pistol of the present invention advantageously has high coupling precision, with light wear with respect to prior-art firearms, together with a repetition cadence of the upper cycle of even 30% with respect to the prior art.

The pistol of the present invention advantageously has precise and repeatable movements, and is therefore able to function for a very high number of cycles.

The pistol of the present invention is advantageously extremely balanced, and thus maintains high firing precision, even when being rapidly fired.

The pistol of the present invention advantageously enables a possible design equipping the barrel bore with mechanical sights or electronic sights borne by the slide. Therefore, this pistol has an optimal inner, outer and terminal ballistic trajectory.

Differently from what is known in the prior art, the present pistol enables dismounting the dismounting pin 38 from the closing organ, as the movement thereof is rotary about the axis X and devolved to the drawing pins 100 that are slidable inside the cams for taking the rotation 101 and does not depend on the dismounting pin 38.

The closing system described advantageously enables reducing the dimensions of the closing organ 10 and the drawing pins 100, and the dismounting pin 38, otherwise termed the dismounting peg.

In fact, the rotary movement about the axis X of the closing organ 10 has lower mechanical stresses with respect to the stresses of the closing organs of known type that perform transversal movements to the axis X. Therefore, as the mechanical stresses that the closing organ 10 must undergo are reduced, the dimensions and consequently the weight of the closing organs 10 are lower with respect to the closing organs of known type. In particular, the weight of the closing organ 10 rotatable with respect to the axis X can be lower than half the weight of closing organ of known type.

Further, differently to the known closing mechanisms, the dismounting pin 38 being decoupled from the closing organ 10, it is possible both to reduce the volume of the dismounting pin 38 up to reaching a diameter of 3 mm, and to reduce the diameter of the drawing pins 100 to diameters of less than 3 millimeters.

Further, advantageously, the compactness and the rotary movement of the closing organ and the relative position of the components responsible for the closing along the longitudinal axis X enable a significant reduction of the distance between the longitudinal axis and the closest point of the user's hand along the grip. This distance is substantially 12 millimeters or less.

The connected technical effect is enormous as the rise of the pistol is substantially eliminated, since the center of thrust of the barrel and the center of resistance of the hand are in an extremely mutually close position.

Consequently, the pistol which is the object of the present invention has maximum rapidity of return to the firing position, and therefore high firing repeatability in rapid firing, for example aimed firing.

This effect is further intensified as the kinematic mechanisms of the firing device are offset with respect to the closing organ 10; therefore, on the one hand a reciprocal interaction thereof is prevented, and on the other hand the pistol dimensions transversally to the longitudinal axis X, in particular in a vertical direction, can be extremely contained.

The rotary movement of the closing organ 10 about the longitudinal axis X of the barrel 4 is advantageously oppositely directed with respect to the rotary movement impressed on the barrel 4 and therefore to the whole pistol 1 by the bullet that turns in screw-fashion along the internal grooving of the barrel 4. In other words, between the advanced configuration and the retracted configuration said closing organ rotates in an opposite direction to the engagement direction of said internal grooving 52 of the barrel 4. Therefore, the closing organ 10, when rotating, at least partially counterbalances the rotary movement impressed by the bullet to the firearm, enabling greater balancing and a better aiming of the firearm.

Having observed the simplicity of the locking system, the pistol of the present invention is advantageously suitable to be produced in an extremely economical way.

The loading of the bullets inside the combustion chamber advantageously takes place substantially along the longitudinal axis; therefore, inside the magazine, the bullets need not be kept with the noses axially located in the magazine at a distance in the order of centimetres as in the prior art. On the contrary, these bullets penetrate into the chamber substantially without interactions with the fore-end and/or with the mouth of the combustion chamber.

In this way, scraping is avoided during said loading, and the present pistol has a higher reliability with respect to traditional firearms.

Each variant described as belonging to a possible embodiment can be realized independently of the other variants described.

The pistol 1 as conceived herein is susceptible to numerous modifications and variants, all falling within the scope of the inventive concept; furthermore, all the details are replaceable by technically equivalent elements. In practice, the materials used, as well as the dimensions, can be any according to the needs and the state of the art.

The invention claimed is:

1. A pistol comprising:

a pistol fore-end;

a barrel, supported by the pistol fore-end, which proximally has a combustion chamber extending along a longitudinal axis;

a slide, translatable longitudinally with respect to the pistol fore-end between an advanced configuration in which it closes the combustion chamber, and a retracted configuration in which it is distanced from the barrel to open said chamber, the orientation of the combustion chamber in the advanced configuration and in the retracted configuration being substantially parallel to said axis, said slide comprising a first locking seat, at least a second locking seat, a first longitudinal grooving and at least a second longitudinal grooving;

said pistol comprises:

a closing organ rotatable around said axis between a first and a second angular position;

at least one element drawing in rotation the closing organ and fixed to the fore-end, said closing organ comprising a first locking relief, at least a second locking relief and at least one cam taking the rotation over from said at least one element for drawing in rotation, said closing organ, in the advanced configuration of the slide, being in said first angular position in which said first and respectively second locking relief engage said first and respectively second locking seat so as to make the barrel and the slide solidly constrained to one another, said closing organ, in the retracted configuration of the slide, being in said second angular position in which said first and respectively second locking relief disengage from said first and respectively second locking seat and slide along said first and respectively second longitudinal grooving present internally on opposite longitudinal walls of the slide so as to enable a balanced and reproducible retraction movement of the slide with respect to the barrel.

2. The pistol according to claim 1, wherein said element for drawing in rotation is a drawing pin, comprising a dismounting pin of the slide from the pistol fore-end separate and structurally independent from said at least one drawing element.

3. The pistol according to claim 2, wherein said drawing element is a pin having a smaller diameter than said dismounting pin.

4. The pistol according to claim 2, wherein said drawing pin is inclined with respect to the dismounting pin.

5. The pistol according to claim 1, wherein said at least one cam is made in the form of a recess having a helical extension.

6. The pistol according to claim 1, wherein said recess extends about said longitudinal axis.

7. The pistol according to claim 1, wherein said closing organ has an internal surface with a cylindrical sector conjoined to the external surface of the barrel and an external surface with a cylindrical sector along which said cam extends.

8. The pistol according to claim 7, wherein said at least one locking relief is projecting from said external surface with a cylindrical sector.

9. The pistol according to claim 1, further comprising an angle between said first angular position and said second angular position is comprised between 10° and 30°.

10. The pistol according to claim 1, wherein the closing organ is solidly constrained in translation to the barrel.

11. The pistol according to claim 1, wherein said barrel has at least one internal grooving having a helical extension along the axis X with a right-hand or left-hand engagement, and in that between the advanced configuration and the retracted configuration said closing organ rotates in an opposite direction to the engagement direction of said grooving.

* * * * *